United States Patent [19]

Fryer et al.

[11] Patent Number: 4,599,073

[45] Date of Patent: Jul. 8, 1986

[54] MAN OVERBOARD RESCUE SYSTEM

[75] Inventors: Douglas M. Fryer, Seattle; Frederick W. Hayes, Bellevue; Richard S. Marshall, Medina, all of Wash.

[73] Assignee: The Sailing Foundation, Seattle, Wash.

[21] Appl. No.: 701,544

[22] Filed: Feb. 14, 1985

Related U.S. Application Data

[63] Continuation-in-part of Ser. No. 631,230, Jul. 16, 1984, abandoned.

[51] Int. Cl.[4] ..... B63C 9/00; B63C 9/08

[52] U.S. Cl. ..... 441/80; 441/84; 441/108

[58] Field of Search ..... 441/80, 83, 84, 85, 441/88, 106, 108, 113, 111, 119

[56] References Cited

U.S. PATENT DOCUMENTS

| | | | |
|---|---|---|---|
| 1,154,860 | 9/1915 | Hendry . | |
| 1,341,529 | 5/1920 | Watts | 441/108 |
| 3,077,618 | 2/1963 | O'Link | 9/337 |
| 3,183,530 | 5/1965 | Girden | 9/311 |
| 3,775,782 | 12/1973 | Rice et al. | 5/82 |
| 4,155,132 | 5/1979 | Lee | 114/90 |
| 4,305,143 | 12/1981 | Simms et al. | 367/134 |
| 4,313,236 | 2/1982 | Tupper et al. | 441/84 |
| 4,343,056 | 8/1982 | McDonald | 441/84 |
| 4,380,441 | 4/1983 | Harr et al. | 441/112 |

OTHER PUBLICATIONS

Photograph of Commercial Horseshoe Approved by the U.S. Coast Guard (Exhibit A).

Photograph of Horse Collar Used by the U.S. Coast Guard (Exhibit B).

John Rousmaniere, "Rescue in the Solvent", *Yachting*, Apr. 1983.

Sydney H. Rogers, "Man Overboard Rescue," *Yachting*, Mar. 1981.

Erroll Bruce, "This is Rough Water Cruising," Sail Books, Inc./W. W. Norton Co., 1980.

Robin Knox-Johnson, "Get the Man Overboard Back Aboard," *Pacific Yachting*.

Eric Tabarley, *Practical Yacht Handling*, David McKay Co., Inc. 1980.

Rich Friese, "Man Overboard", *Cruising World*, Dec. 1983.

Kadematic Rescue System (Original 2 pp. in German and 3 pp. English translationssubmitted herewith).

Speedymat Rescue System (Orignal 2 pp. in German and 3 pp. English translation submitted herewith).

*Primary Examiner*—Sherman D. Basinger

*Attorney, Agent, or Firm*—Graybeal & Cullom

[57] ABSTRACT

A method of rescuing a person who has fallen overboard from a boat, including the following steps. As a first step, promptly after the person has fallen overboard, stopping the boat and deploying into the water a flotation sling on a floating tether line secured to the boat. As a second step, maneuvering the boat in order to progressively circle the person in the water so that the tether line and then the flotation sling are in reach of or contact the person, whereupon the person can place the flotation sling under his arms, and does so. As a third step, essentially stopping the boat. As a fourth step, hauling in the tether line so that the person in the flotation sling is drawn alongside the boat. And, as a fifth step, hoisting the flotation sling and person supported therein out of the water and onboard the boat to complete the rescue. The flotation sling includes the following elements: (a) a central grasp section; (b) a first buoyancy section and a second buoyancy section; (c) a main support strap; and (d) a first resilient ring and a second resilient ring.

4 Claims, 5 Drawing Figures

MAN OVERBOARD RESCUE SYSTEM

CROSS-REFERENCE TO RELATED APPLICATION

This application is a continuation-in-part of our copending U.S. application Ser. No. 06/631,230 filed July 16, 1984 and entitled "Man Overboard Rescue System", now abandoned.

BACKGROUND OF THE INVENTION

1. Field of the Invention

The present invention relates to man overboard rescue systems and methods. The man overboard situation is a much more difficult marine problem than many people perceive, and the present invention provides a reliable retrieval method. A typical use of the present invention is to rescue a sailboat crew member in the most exigent situation, namely, where there is a two-person crew and one of them goes overboard requiring a single-handed pickup by the other in fresh wind and sea conditions, exacerbated by cold water temperatures of 50° F. or less which are commonly present in northern waters.

2. Description of the Prior Art

Two case histories may be described to illustrate the great need for the present invention. The first case occurred on a gray, rainy winter day on Puget Sound. Gale warnings had been up since early morning. The race committee set the starting line and the fleet worked to windward against a freshening southwest wind. One of the smaller competitors was a 26-foot Thunderbird sailboat crewed by a man and wife. It fell behind its competitors and was soon sailing alone.

The Thunderbird was beginning to be overpowered and the couple decided to reduce sail. The man went forward to muzzle the jib; in the process, it blew back up the forestay. He lurched for it and slipped over the side. Immediately, he grabbed the lee shrouds. His wife had experience in steering the boat, but never in an emergency situation. She maintained course; he could not pull himself aboard and, gradually weakening, slipped away. The woman, panic stricken, continued her course right through the surf and onto a beach. One week later, the man's float coat was found eight miles north. He was never seen again. The incident was widely discussed in sailing circles for some months afterward.

The second case history repeated the first incident with a variation. It was Labor Day weekend. A couple and their daughter were sailing a 26-foot sloop on Puget Sound. A dark squall blew over them. The husband clipped a harness to the rail as he went forward to lower the jib. He slipped and went overboard. As in the first incident, his wife maintained course. The tether to the man's lifeline was over six feet long, just enough to tow him at over six knots in the quarter wave. The husband was unable to release himself or climb aboard and drowned within two minutes.

From the study of many such case histories, some conclusions may be drawn: (1) a reliable boat handling method known to at least two crew members is a must; (2) visual contact with the victim must be maintained; (3) the use of engines may be dangerous, especially with the inexperienced boat handler; (4) drowning, not hypothermia, is the primary danger; (5) hypothermia will be substantially reduced if the victim can get out of the water even though soaking wet; (6) panic must be dealt with; (7) some lifting device to get the victim back aboard is necessary; (8) following the victim into the water is risky and probably ineffective; (9) man overboard prevention including harness gear should be employed; and (10) life jackets are a must.

Some published recommendations are as follows. Pickup under sail on a close reach was recommended after a successful pickup with a full crew of a man standing on the up-turned bottom of a small craft. John Rousmaniere, "Rescue In The Solent," *Yachting,* April 1983. Recording the log, starting a stop watch, then calling all hands on deck to turn the boat around is another suggestion. Sydney H. Rogers, "Man Overboard Rescue," *Yachting,* March 1981. One writer compares the attributes of a tack and luff approach with the "classic man overboard maneuver" described as an immediate jibe, then an approach on a gradual luff. Erroll Bruce, *This Is Rough Water Cruising,* Sail Books, Inc./W. W. Norton Co. 1980. Dropping all sails and starting the engine was successfully used in the 1977 Whitbread Race by Robin Knox-Johnson (with full racing crew it took 20 minutes). He recommends this as a standard procedure. Robin Knox-Johnson, "Get the Man Overboard Back Aboard," *Pacific Yachting.* Eric Tabarley describes a methodology of throwing the man overboard a pole, heading at right angles to the wind, proceeding a few lengths, bearing away and jibing, luffing onto a reach, coming up wind, tacking with jib aback, and thus heaving to the windward of the person in the water. Eric Tabarley, *Practical Yacht Handling,* David McKay Company, Inc. Another method is to maintain and log your course, throw a horseshoe-type flotation device, drop sails, and power back. Rick Friese, "Man Overboard!" *Cruising World,* December 1983.

The prior art also includes the Kadematic and Speedymat rescue systems which involve circling the victim, but the disclosed rescue vest does not appear to have the capability of being used to hoist the victim onboard.

SUMMARY OF THE INVENTION

One aspect of the invention is a method of rescuing a person who has fallen overboard from a boat, including the following steps. As a first step, promptly after the person has fallen overboard, stopping the boat and then deploying into the water a flotation sling on a floating tether line secured to the boat. As a second step, maneuvering the boat in order to progressively circle the person in the water so that the tether line and then the flotation sling are in reach of or contact the person, whereupon the person can place the flotation sling under his arms, and does so. As a third step, essentially stopping the boat. As a fourth step, hauling in the tether line so that the person in the flotation sling is drawn alongside the boat. And, as a fifth step, hoisting the flotation sling and person supported therein out of the water and onboard the boat to complete the rescue.

Another aspect of the invention is the flotation sling. It includes the following elements: (a) a fabric-covered central grasp section, the central grasp section being relatively pliable and having a first end and a second end; (b) a first fabric-covered buoyancy section containing a quantity of buoyant flotation material and a second fabric-covered buoyancy section containing a quantity of buoyant flotation material, the first and second buoyancy sections extending longitudinally and being relatively non-pliable, the first buoyancy section being connected to the first end of the central grasp section and the second buoyancy section being connected to the second end of the central grasp section; (c) a main support strap having a first end and a second end, the main support strap extending through the first buoyancy section, the central grasp section, and the second buoyancy section; and (d) a first resilient ring and a second resilient ring, the first resilient ring being connected to the first end of the support strap and the second resilient ring being connected to the second end of the support strap. The flotation sling is sufficiently buoyant to support the weight of an adult person in the water and has sufficient strength to support the weight of an adult person being hoisted out of the water in it.

Another aspect of the invention is an apparatus used for rescuing a victim who has fallen overboard from a boat comprising the aforementioned flotation sling in combination with a tether line having a loop connected through the first and second rings of the flotation sling and a storage container for storing the tether line.

DESCRIPTION OF THE PREFERRED EMBODIMENTS

In general terms, the present invention is a man overboard rescue system which simplifies the pickup of a person who has fallen overboard and is the only known, tested method for a single-handed rescue. The present invention provides a means of reaching the victim quickly with a flotation sling attached to a tether line and then of retrieving the person onboard. The method explained herein involves a sailboat, but the principles are equally applicable to other watercraft.

The present invention was developed after extensive sea trials showed that most of the traditional man overboard rescue procedures were inadequate. The present method is effective in short-handed situations. For example, a woman onboard alone can retrieve a heavy man. The system can also be used for a fast rescue by a full crew. Obviously, poor boat handling or bad seamanship can render any rescue effort ineffective.

Research has shown that the victim cannot be expected to aid his rescuers. A tackle or other lifting device is essential. Most victims, even those wearing a personal flotation device, cannot grasp a line after about twenty minutes or even less in cold, rough water. The victim becomes exhausted in as little as five minutes without a personal flotation device. A medium weight man may weigh more than two hundred and fifty pounds with the weight of water in heavy clothes. Ladders provide only minimum help even under mild weather conditions.

Figure 2:
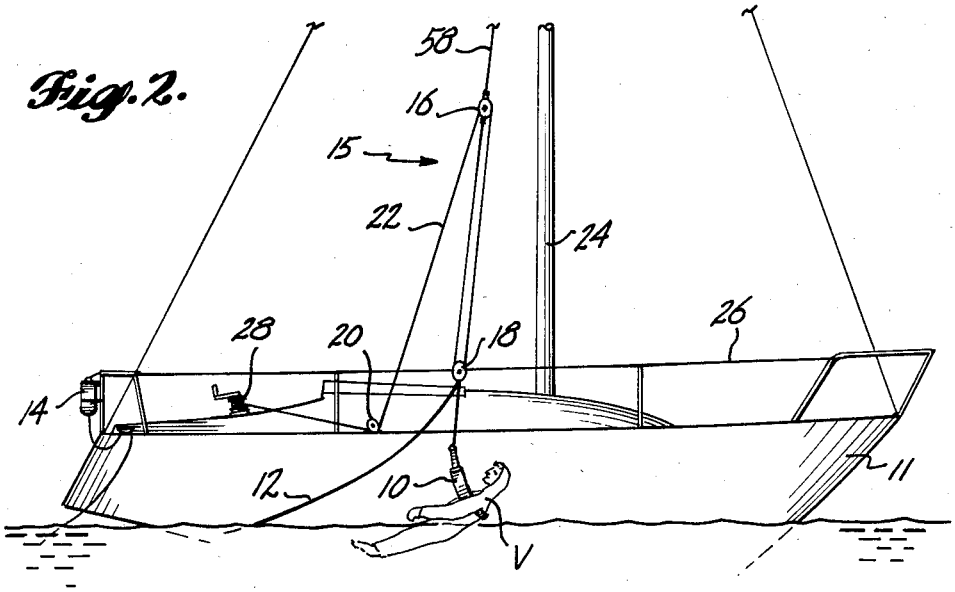
FIG. 2 is a side elevational view of a victim about to be hoisted out of the water according to the method of the invention.
Figure 3:
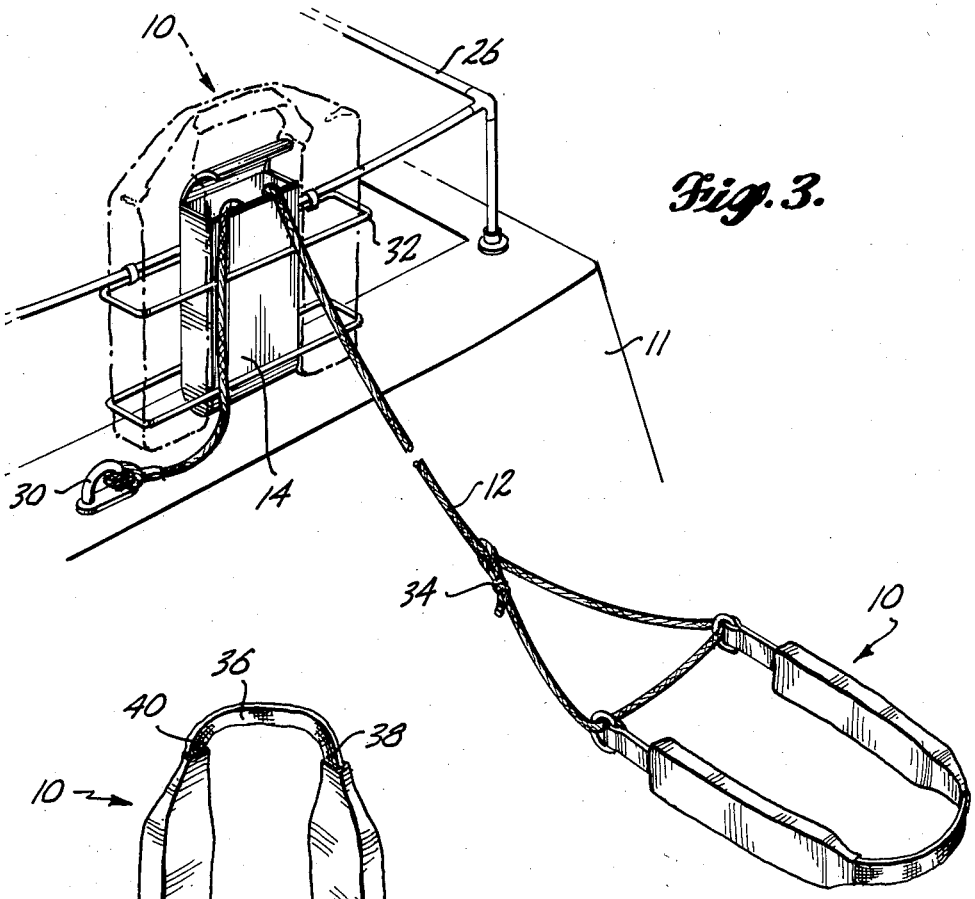
FIG. 3 is a perspective view of typical apparatus used in the man overboard rescue system of the present invention.

As shown in FIGS. 2 and 3, the equipment of the present invention includes a flotation sling 10, a floating tether line 12, a storage container or stowage box 14 for the line 12, and a hoisting tackle 15. The length of the tether line 12 should be at least three times the boat length, but no less than one hundred and fifty feet. The tether line 12 is looped through two D-rings 54 and 56 on the ends of the flotation sling 10 and then the tether line 12 is tied with a bowline knot 34. The size of the loop in the tether line 12 should be large enough to reach above the sailboat railing when the flotation sling 10 is in the water. This provides easy attachment of the loop to the hoisting tackle 15 (FIG. 2) on board the sailboat 11. The other end of the tether line 12 is permanently secured to any strong point on board the sailboat 11, such as the deck ring 30, and the remainder of the tether line 12 is stowed in the storage container 14 to allow a free run when the floation sling 10 is deployed.

Figure 4:
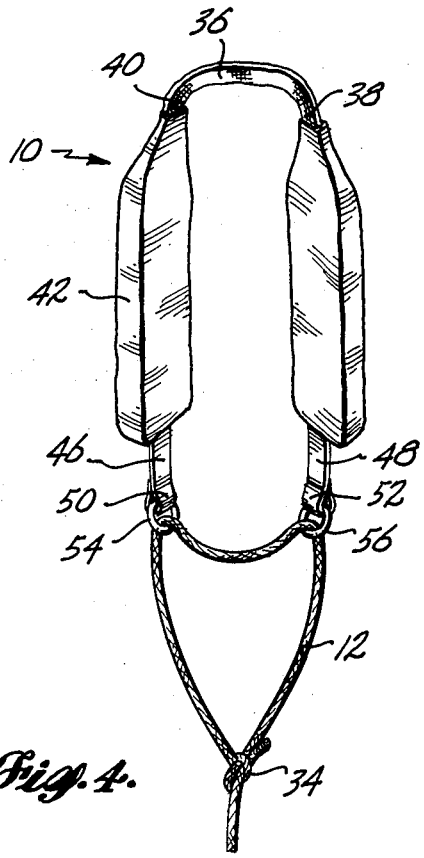
FIG. 4 is a plan view of the flotation sling which forms a part of the man overboard rescue system.

As shown in FIG. 4, the flotation sling 10 has a central grasp section 36 which is relatively flexible or pliable and preferably contains a quantity of buoyant flotation material, two hinge areas 38 and 40 which are foldable and which contain no buoyant flotation material, two fabric-covered buoyancy sections 42 and 44 which are relatively inflexible or non-pliable and which contain buoyant foam sufficient to meet U.S. Coast Guard approval for Type IV personal flotation devices, and a high-strength main support strap having a first end 46 and a second end 48 which are looped around two D-rings 54 and 56. The main support strap 46, 48 extends through the first buoyancy section 42, the central grasp section 36, and the second buoyancy section 44. Alternatively, the main support strap could be made in two pieces, each of which is attached to one of the buoyancy sections if the buoyancy sections are made with sufficient strength to support the weight of an adult person being hoisted out of the water. The D-rings 54 and 56, in conjunction with the loop in the tether line 12, provide ease of opening when the victim enters the sling 10 and they secure the closure around the victim during the recovery phase.

The hoisting tackle 15 shown in FIG. 2 may have two to four parts depending on the capacity of the winch 28 and the type and size of the boat. It is recommended that a hoisting tackle be carried onboard and rigged specifically for rescue use.

EXAMPLE

The flotation sling 10 and the tether line 12 may be constructed according to the following example. The fabric cover of the sling 10 is made of waterproof yellow Herculite material or its equivalent with a Delrin zipper for access inside to the buoyant flotation material. The buoyancy sections 42 and 44 are about seventeen inches long and contain a core of foam flotation material which is Bevalite #10296 NL MQ 524 or its equivalent in a sufficient quantity to provide twenty pounds of flotation and meet U.S. Coast Guard approval for Type IV personal flotation devices. The pliable central grasp section 36 is about eighteen inches long and contains a core of the same foam flotation material. The hinge areas 38 and 40 are about one inch in length and they contain no foam flotation material. The main support strap 46, 48 is about seventy inches long, about two inches wide, and is made of strong nylon or polypropylene web or its equivalent. The resilient rings 54 and 56 are stainless steel D-rings or their equivalent. The floating tether line 12 is made of kink-resistant Samson #12 braided halter cord or its equivalent.

Figure 1:
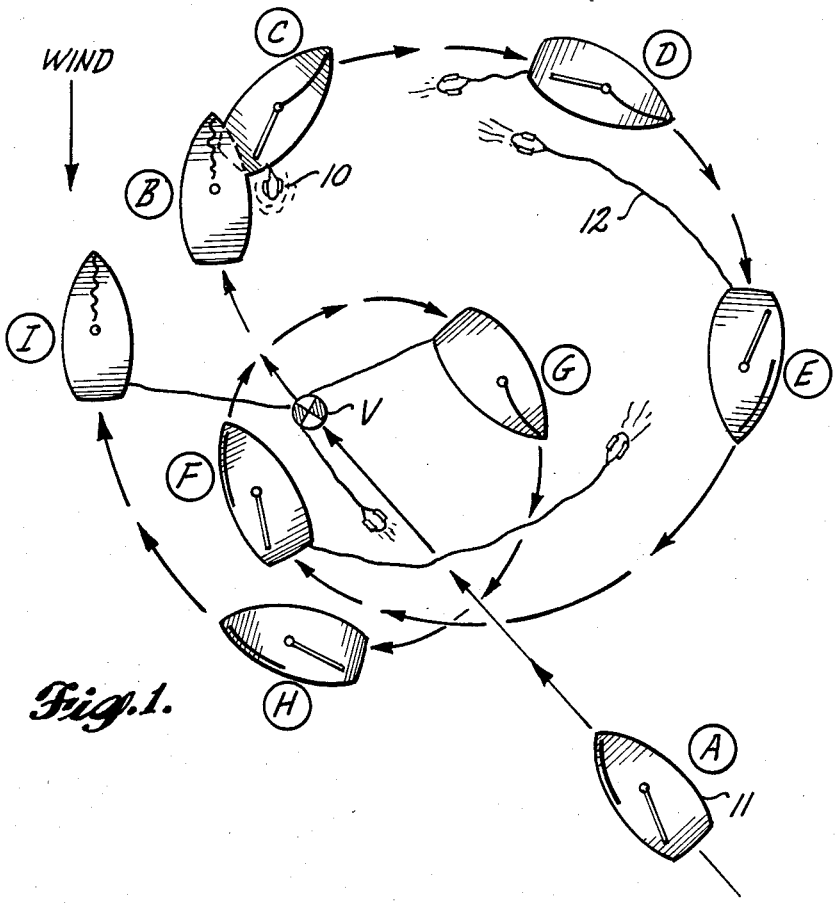
FIG. 1 is a schematic representation of a sailboat involved in a man overboard emergency and then subsequently following the method of the present inventin in rescuing the victim.

The method of the present invention is illustrated schematically in FIG. 1. At position A, the sailboat 11 has no problems and all crew members are onboard. At position X, the victim V falls overboard.

After the victim falls overboard, the sailboat 11 should change course as shown at position B. Sailors, whether running, reaching, or beating, should put the helm down, to head the boat into the wind and luff. Maneuvering under sail works best from a reach or when on the wind. Sailing tests also show that turning the boat into the wind under spinnaker is effective. The alternative of sailing off and returning after the chute is under control usually results in losing sight of the victim. Even a one foot sea may hide the head of someone in the water from a rescuer, thus regaining sight of the victim may be very difficult. The downwind point of sail is the most dangerous in a man overboard situation. The attitude of the victim is important to his survival. Tests have shown that close proximity to the rescue vessel, and some means of flotation are very important to the victim's state of mind and therefore to his ability to survive.

A boat under power should be depowered. Immediate action whether under sail or power keeps the boat near the man in the water. The flotation sling 10 is deployed as shown in position C and thrown towards the victim. If the engine is on, it is very important not to tangle the tether line 12 in the propeller.

As shown in position D, the boat should go about and should be sailed in circles around the victim as shown in positions E through H, towing the flotation sling 10. It is recommended that the boat be maneuvered under sail. This has proven fast and effective under most conditions. A sailboat tends to foul her propeller in trailing lines, becoming helpless with sails down and engine inoperative. However, engine use may be essential under some conditions. The tether line 12 pays out of its container 14 if it has been stowed properly by being flaked into the stowage container 14 approximately six inches at a time to prevent tangling. It should then pay out easily.

Contact with the victim V usually is made on the first or second turn. After contact with the victim, the boat is stopped immediately as shown in position I. Head into the wind and drop all sails. Do this before pulling the victim to the boat. A boat under power must cut the engine completely to prevent fouling the tether line 12 or maiming the victim with the propeller.

The victim V should put the sling under his arms, so that he will float and can be retrieved whether conscious or not. The victim should not be towed because he could drown in his own wave if towed too fast. This is very important and may be the most potentially dangerous part of the procedure. Should towing of the victim occur, the victim should turn in the sling to face away from the boat so that the wave is at his back which allows him to breathe.

Pull the victim V alongside the boat as soon as it has stopped. Lift him from the water as far as possible and tie the tether line 12 to a cleat. This prevents the victim from falling from the sling 10 if he loses consciousness. The victim is then secure and the rescuer has time to rig the hoisting tackle 15.

As shown in FIG. 2, the upper block 16 of the tackle 15 should be suspended about ten feet up from the deck to prevent two-blocking. Any halyard 58 may be used. The tackle 15 is suspended from the halyard 58 and the lower block 18 reaches to about deck level. Clip the lower block 18 to the tether line loop outside the lifeline 26 on the boat and lead the fall through a block 20 on the deck to the winch 28. Crank the victim up and over the lifeline 26. The tackle 15 should be fitted to the individual boat and the crew members should practice using the tackle.

Figure 5:
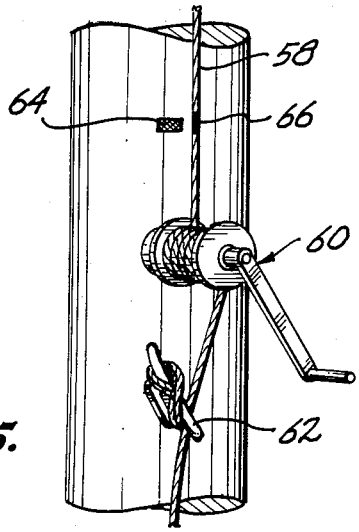
FIG. 5 is a side elevational view showing a mast and halyard as employed in hoisting the victim out of the water.

One method of positioning the upper block 16 of the tackle 15 at the correct height of ten feet above the deck is illustrated in FIG. 5. A reference mark 64 is painted on the mast 24 and a corresponding reference mark 66 is painted on the halyard 58 to indicate when the upper block 16 has reached the proper height above the deck. When the reference marks 64 and 66 are aligned, the operator stops the halyard winch 60 and secures the halyard on the cleat 62.

The hoisting procedure for power boats may be more difficult. Some power boats have transom doors and swimming platforms. Others have davits that can carry the load. Some have strong points high on the cabin where a tackle may be fastened. The owner of each boat must determine the best lifting procedure and practice with it.

As will be apparent to those skilled in the art to which the invention is addressed, the present invention may be embodied in forms other than those specifically disclosed above without departing from the spirit or essential characteristics of the invention. The particular embodiments of the man overboard rescue system, as described above, are therefore to be considered in all respects illustrative and not restrictive, with the scope of the present invention being set forth in the appended claims rather than being limited to the foregoing description.

What is claimed is:

1. A flotation/hoisting sling used for rescuing a person who has fallen overboard from a boat, comprising:

(a) a fabric-covered central grasp section about eighteen inches long containing a quantity of buoyant foam flotation material, said central grasp section being relatively pliable and having a first end and a second end;

(b) a first fabric-covered buoyancy section about the same length as said central grasp section and containing a quantity of buoyant foam flotation material and a second fabric-covered buoyancy section about the same length as said central grasp section and containing a quantity of buoyant foam flotation material, said first and second buoyancy sections extending longitudinally and being relatively non-pliable, said first buoyancy section being connected to the first end of said central grasp section and said second buoyancy section being connected to the second end of said central grasp section;

(c) a main support strap at least about seventy inches long having a first end and a second end, said main support strap extending through said first buoyancy section, said central grasp section, and said second buoyancy section;

(d) a first resilient D-ring and a second resilient D-ring, said first D-ring being connected to said first end of said main support strap and said second D-ring being connected to said second end of said main support strap; and (e) said flotation/hoisting sling having sufficient strength to support the weight of an adult person being hoisted out of the water in said flotation/hoisting sling and containing a sufficient quantity of said buoyant foam flotation material to provide about twenty pounds of flotation as required by U.S. Coast Guard specifications for Type IV personal flotation devices.

2. Apparatus used for rescuing a person who has fallen overboard from a boat or the like, comprising:

(a) a flotation/hoisting sling comprising:

(i) a fabric-covered central grasp section about eighteen inches long and containing a quantity of buoyant foam flotation material, said central grasp section being relatively pliable and having a first end and a second end;

(ii) a first fabric-covered buoyancy section about the same length as said central grasp section containing a quantity of buoyant foam flotation material and a second fabric-covered buoyancy section about the same length as said central grasp section containing a quantity of buoyant foam flotation material, said first and second buoyancy sections extending longitudinally and being relatively non-pliable, said first buoyancy section being connected to the first end of said central grasp section and said second buoyancy section being connected to the second end of said central grasp section;

(iii) a main support strap at least about seventy inches long having a first end and a second end, said main support strap extending through said first buoyancy section, said central grasp section, add said second buoyancy section;

(iv) a first resilient D-ring and a second resilient D-ring, said first D-ring being connected to the first end of said main support streap and said second D-ring being connected to the second end of said main support strap; and (v) said flotation/hoisting sling having sufficient strength to support the weight of an adult person being hoisted out of the water in said flotation/hoisting sling and containing a sufficient quantity of said buoyant foam flotation material to provide about twenty pounds of flotation as required by U.S. Coast Guard specifications for Type IV personal flotation devices;

(b) a floating tether line at least one hundred and fifty feet in length having a loop connected through said first and second D-rings of said flotation/hoisting sling; and (c) a storage means for storing said tether line.

3. In combination with a boat or the like, a main overboard rescue system for rescuing a person who has fallen overboard from the boat, comprising:

(a) a flotation/hoisting sling comprising:

(i) a fabric-covered central grasp section about eighteen inches long and containing a quantity of buoyant foam flotation material, said central grasp section being relatively pliable and having a first end and a second end;

(ii) a first fabric-covered buoyancy section about the same length as said central grasp section containing a quantity of buoyant foam flotation material and a second fabric-covered buoyancy section about the same length as said central grasp section containing a quantity of buoyant foam flotation material, said first and second buoyancy sections extending longitudinally and being relatively non-pliable, said first buoyancy section being connected to the first end of said central grasp section and said second buoyancy section being connected to the second end of said central grasp section;

(iii) a main support strap at least about seventy inches long having a first end and a second end, said main support strap extending through said first buoyancy section, said central grasp section, and said second buoyancy section;

(iv) a first resilient D-ring and a second resilient D-ring, said first D-ring being connected to the first end of said main support strap and said second D-ring being connected to the second end of said main support strap; and (v) said flotation/hoisting sling having sufficient strength to support the weight of an adult person being hoisted out of the water in said flotation/hoisting sling and containing a sufficient quantity of said buoyant foam flotation material to provide about twenty pounds of flotation as required by U.S. Coast Guard specifications for Type IV personal flotation devices;

(b) a floating tether line at least one hundred and fifty feet in length having a loop connected through said first and second D-rings of said sling, by means of which the person in the water and supported by the sling is brought alongside the boat and the tether line secured to a cleat or the like; and (c) block and tackle means rigged on said boat for attaching to the tether line loop and directly hoisting said flotation/hoistigg sling and the person supported therein out of the water and onboard the boat.

4. The combination of claim 3, wherein said boat is a sailboat and said block and tackle means is rigged when needed to a halyard of the sailboat with the top block at least ten feet above the boat deck.

* * * * *